US005322024A

United States Patent [19]

Avery et al.

[11] Patent Number: 5,322,024

[45] Date of Patent: Jun. 21, 1994

[54] MODULAR MERCHANDISE DISPLAY UNIT

[75] Inventors: Frederick M. Avery; Ronald J. Macsenti, both of Phoenix, Ariz.

[73] Assignee: The Niven Marketing Group, Scottsdale, Ariz.

[21] Appl. No.: 911,927

[22] Filed: Jul. 10, 1992

[51] Int. Cl.[5] ..... A47B 57/00

[52] U.S. Cl. ..... 108/64; 108/102

[58] Field of Search ..... 108/64, 109, 151, 152, 108/106, 153, 102, 150

[56] References Cited

U.S. PATENT DOCUMENTS 2,540,353 2/1951 Schick ..... 108/25

2,787,382 4/1957 Williams ..... 108/64

OTHER PUBLICATIONS

*Proposal For Baked Goods Merchandising System,* The Niven Marketing Group, Jul. 11, 1991.

*Baked Goods Merchandising System-Stage II,* The Niven Marketing Group, Aug. 12, 1991.

*Primary Examiner*—Kenneth J. Dorner

*Assistant Examiner*—Gerald Anderson

*Attorney, Agent, or Firm*—Wallenstein, Wagner & Hattis, Ltd.

[57] ABSTRACT

A modular merchandise display unit comprising an upright, substantially vertical wall having opposite sides and a pair of opposite ends. The substantially vertical wall is normally positioned along a central axis of the merchandise display unit. A base is provided for supporting the upright wall, and this base includes a pair of axially-disposed sockets and a pair of offset sockets. The display unit further includes a plurality of elongated shelves with merchandise receiving surfaces. These shelves are removably connected to and extend outwardly from the opposite sides of the upright wall. Curved shelves are securable to the merchandising display unit at opposite ends of the upright walls. These curved shelves have merchandise receiving surfaces which may or may not merge smoothly with the surfaces of a pair of elongated shelves. Each pair of elongated shelves is disposed on the opposite sides of the upright walls. The axially-disposed sockets and offset sockets permit movement of the upright wall from a position along the central axis of the unit to a position offset from the central axis.

18 Claims, 5 Drawing Sheets

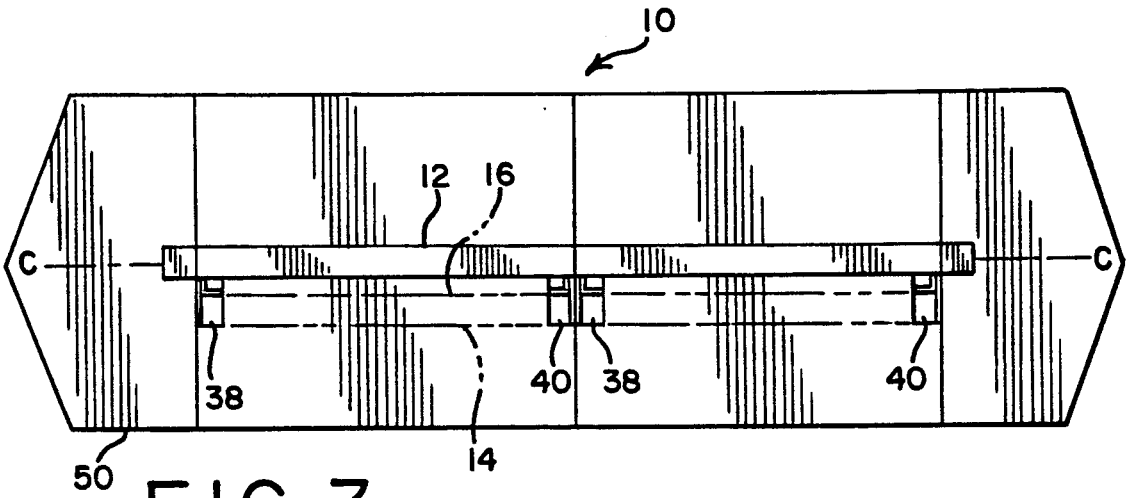
FIG. 3
FIG. 4
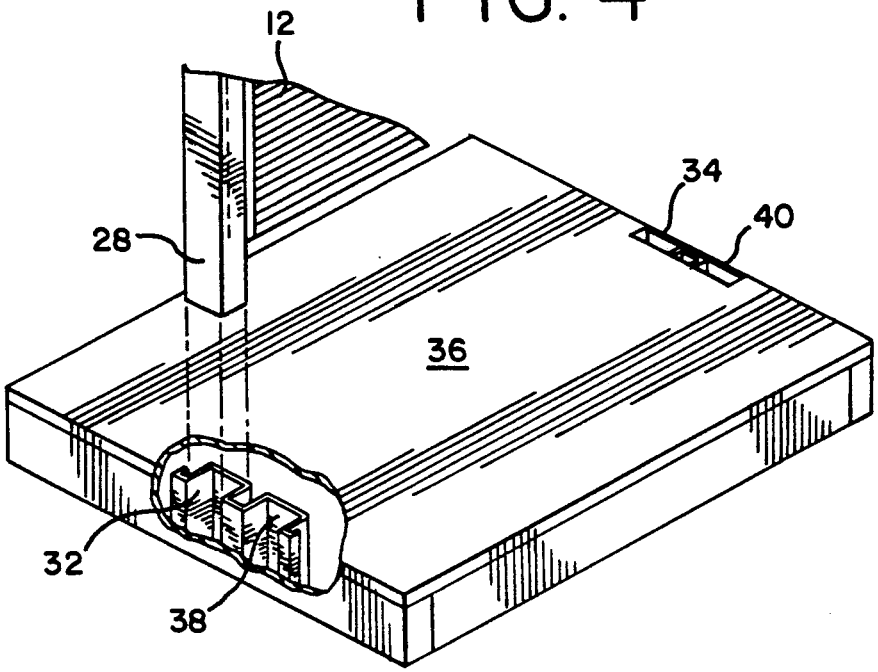

MODULAR MERCHANDISE DISPLAY UNIT

TECHNICAL FIELD

The invention relates generally to modular merchandise display units. More particularly, the invention relates to modular merchandise display units which include removable shelves. These removable shelves cascade in size from top to bottom, small to large, which, in turn, present retail products to the customer in an easy to view, easy to shop, ergonomic format. These shelves are securable at various points around the periphery of the display unit. In this way, the shelves combine to give the impression of a continuous display unit which displays merchandise around its entire periphery without the use of sides and abrupt ends, as is typical of prior art product gondola merchandisers.

BACKGROUND OF THE INVENTION

Purchasing decisions can be greatly influenced by the display of merchandise. A merchandise display unit which attracts attention and displays goods in a pleasing and accessible manner encourages shoppers to purchase items on impulse.

Typically, retail stores have uniform, parallel rows of shelves and uniform, grid-like aisles permitting access to those shelves. Merchants who wish to highlight certain goods for impulse purchase will often provide free-standing merchandise display units at the end of a row of shelves or in the middle of some of the larger aisles. The best of such free-standing merchandise display units will permit viewers to see as much merchandise as possible. Ideally, such units will also themselves be attractive so that shoppers will look in their general direction, thus increasing the likelihood that the merchandise on those units will be viewed and purchased by the shoppers.

Merchandise is frequently sold in containers of various sizes. In addition, certain merchandise is in greater demand than other merchandise. With the changing seasons, this demand can fluctuate to an even greater extent. Some merchandise is suited to display in deep containers, while other merchandise is more suitably displayed on flat or angled shelves. For all of these reasons, an ideal merchandise display unit would provide for maximum flexibility and changes of that unit into various configurations, with various shelf sizes and types.

SUMMARY OF THE INVENTION

The invention is a modular merchandise display unit. This unit comprises an upright, substantially vertical wall having opposite sides and a pair of opposite ends. Normally, this substantially vertical wall is positioned along a central axis of the merchandise display unit. A base is provided for supporting the upright wall, and this base includes a pair of axially-disposed sockets and a pair of offset sockets.

The display unit further includes a plurality of elongated shelves with merchandise receiving surfaces. These shelves are removably connected to and extend outwardly from the opposite sides of the upright wall.

Curved shelves are securable to the merchandising display unit at opposite ends of the upright walls. These curved shelves have merchandise receiving surfaces which may or may not merge smoothly with the surfaces of a pair of elongated shelves. Each shelf of this pair of elongated shelves is disposed on the opposite sides of the upright wall.

The axially-disposed sockets and offset sockets permit movement of the upright wall from a position along the central axis of the unit to a position offset from the central axis.

In a further aspect of the invention, the curved shelves of the modular merchandise display unit are semi-hexagonal. Yet another aspect of the invention provides for shelves having substantially horizontal merchandise receiving surfaces. Such horizontal surfaces are most suitable for large and heavy merchandise.

A still further aspect of the invention provides for shelves having merchandise receiving surfaces which extend downwardly and outwardly from the upright wall. Such shelves are more suitable for lightweight, carded merchandise. To further aid in retaining such merchandise upon these downwardly and outwardly extending merchandise receiving surfaces, the unit may include a vertical or diagonal upwardly-opening slot along a peripheral edge of each of the shelves for retaining a goods-retaining, rectangular stop or face. Such rectangular stops or faces may also be sufficiently high, such that they together form walls, resulting in the formation of bins.

In a still further aspect of the invention, the merchandise receiving surface includes an opening for receiving a divider. This opening may be defined by a pair of substantially parallel wires.

Accordingly, it is an object of the invention to provide a merchandise display unit which attracts attention and displays goods in a pleasing and accessible manner, encouraging impulse shopping.

It is a further object of this invention to provide an attractive merchandise display unit which permits viewers to see as much merchandise as possible.

It is still a further object of the invention to provide a merchandise display unit which can accommodate merchandise in containers of various sizes and configurations, providing that unit with maximum flexibility.

BRIEF DESCRIPTION OF THE DRAWINGS

FIG. 3 is an overhead view of the merchandise display unit of FIG. 1, but with a pair of bases for elongated shelves; and showing, in solid lines, the upright wall in its position along the central axis C of that unit and, in phantom lines, the upright wall in its position offset from the central axis C.

FIG. 4 is a perspective view, partially in section, of the base which supports the upright wall; and showing a pair of offset sockets.

DETAILED DESCRIPTION OF THE PREFERRED EMBODIMENT

Figure 9:
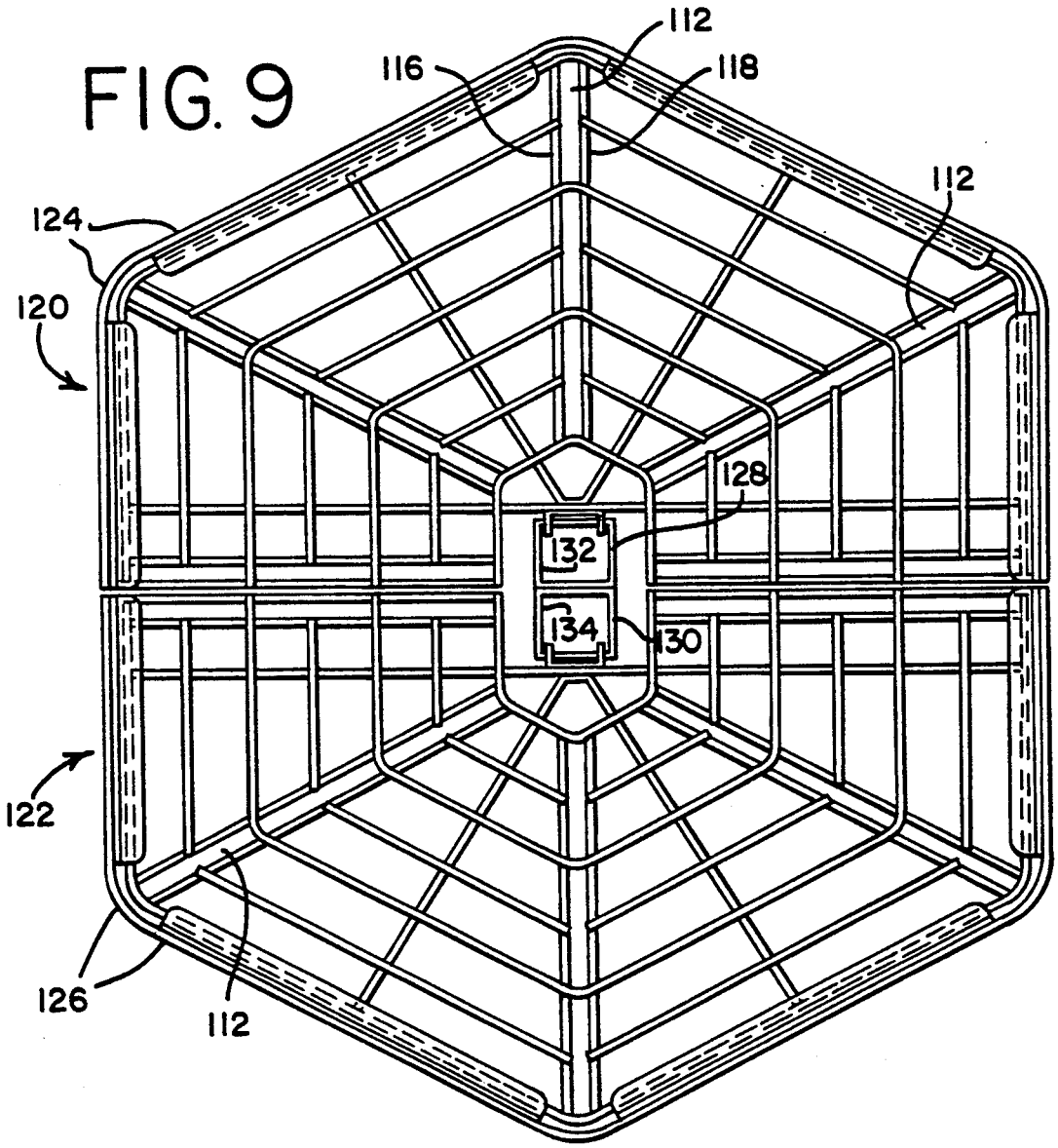
FIG. 9 is an overhead view of another aspect of the invention; and showing two end cap bases in back-to-back relationship to form a substantially hexagonal merchandise display unit.

Preferred embodiments of the present invention are shown in the accompanying figures. In particular, a first embodiment is shown in FIGS. 1–7, and a second embodiment is shown in FIG. 9.

Figure 1:
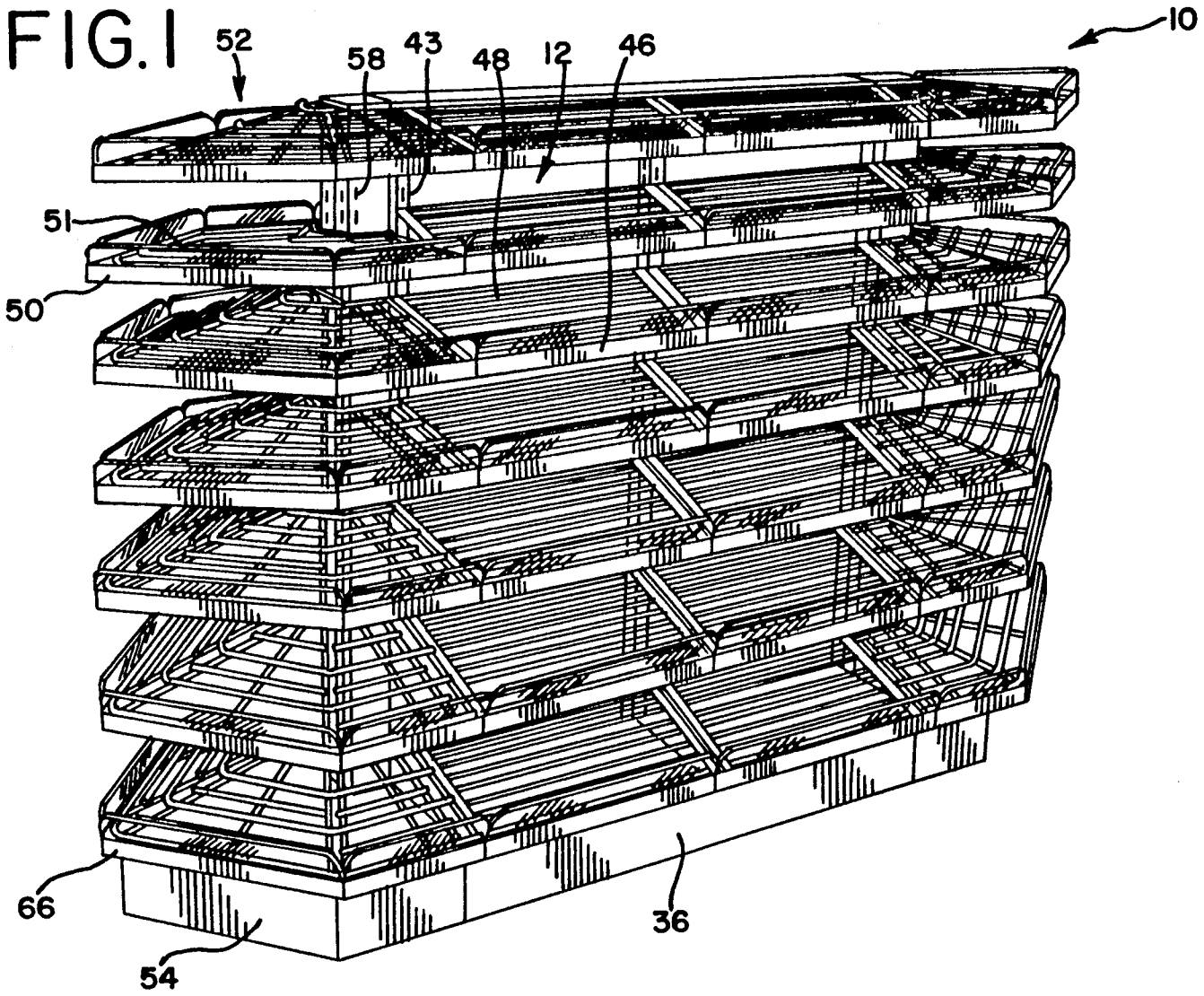
FIG. 1 is a perspective view of an embodiment of the modular merchandise display unit of the invention; and showing curved shelves, some of which merge smoothly with the corresponding elongated shelves and others which are vertically offset from the corresponding elongated shelves.

Referring now to FIG. 1, a modular merchandise display unit 10 in accordance with the invention is shown. In FIG. 1, the display unit 10 is shown in a fully assembled condition. As will be explained below, this unit 10 may be disassembled and portions removed or added to create merchandise display units having appearances that are substantially different from the appearance of the embodiment shown in FIG. 1.

The unit 10 includes an upright, substantially vertical wall 12 having opposite sides 14 and 16, and a pair of opposite ends 18 and 20. One or more of these sides 14 and 16 may instead be provided with slats (not shown), thereby creating a so-called slat wall. Such a slat wall facilitates the optional provision of slat-secured hook elements or the like. Such hook elements are suitable for the hanging of bagged merchandise, such as dried fruits, candy or nuts.

Normally, as shown in the solid lines of FIG. 3, the upright vertical wall 12 is positioned along a central axis C of the merchandise display unit. As such, this upright vertical wall 12 provides a symmetry to the merchandise display unit. As may be seen from FIG. 4, this vertical wall includes, at its lower end, stakes, such as stake 28, for insertion into a pair of correspondingly sized, axially-disposed sockets 32 and 34. FIG. 4 shows in detail that these sockets 32 and 34 are formed in a base 36, which provides overall support for the upright wall 12. That base 36 further includes a pair of offset sockets 38 and 40. In the preferred embodiment, the centers of these sockets 38 and 40 are offset from the centers of sockets 32 and 34 by 3 inches.

Figure 2:
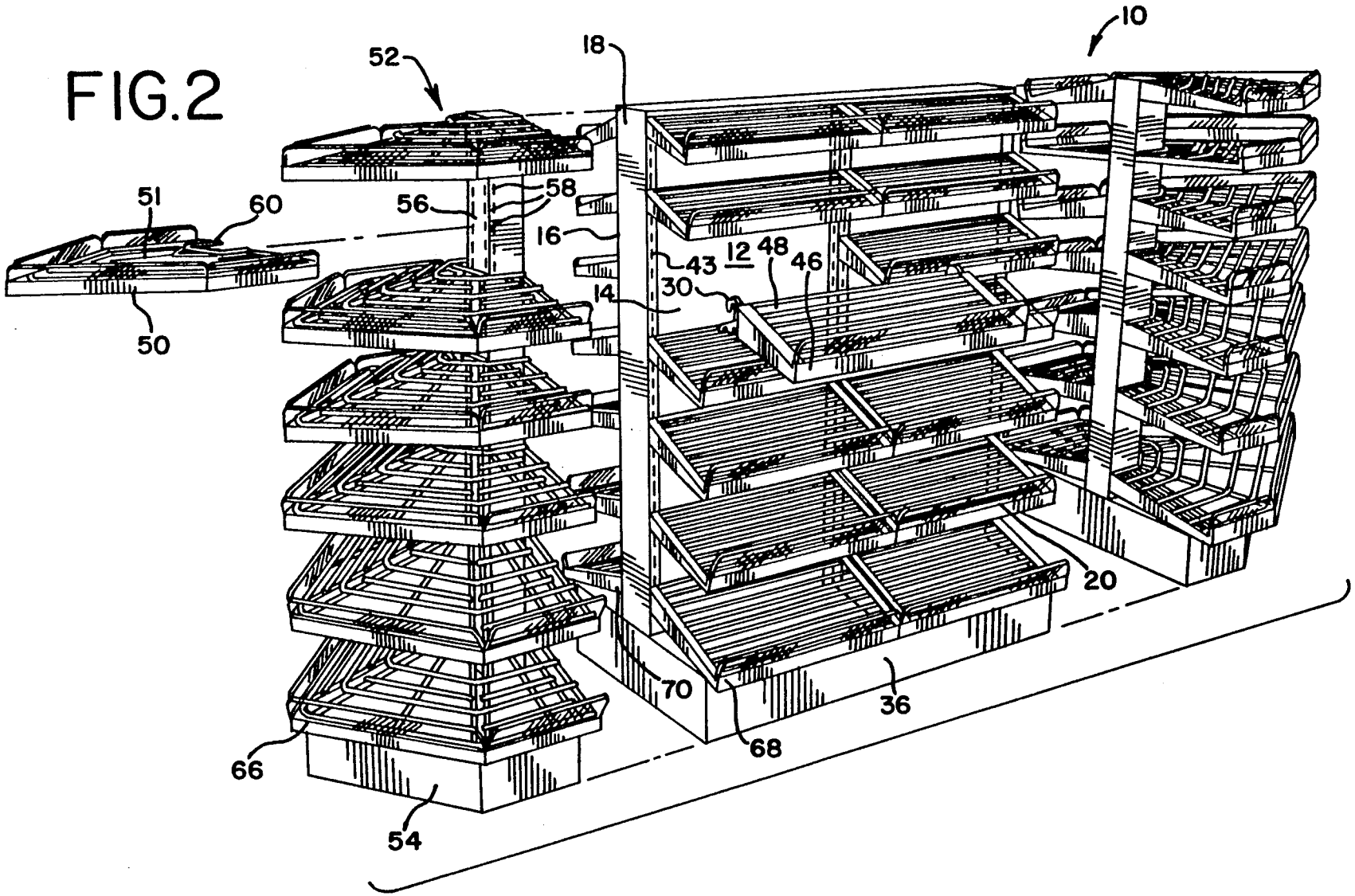
FIG. 2 is an exploded view of the merchandise display unit of FIG. 1.

A plurality of elongated shelves are provided on the opposite sides 14 and 16 of vertical wall 12. Each of these elongated shelves has a merchandise receiving surface. Some of these shelves may have a horizontal merchandise receiving surface. As seen in FIGS. 1 and 2, other shelves, such as shelf 46, have sloping merchandise receiving surfaces 48, i.e., surfaces which extend outwardly and downwardly from the side of the upright wall 12. Elongated shelves 46 include tab portions 30 for vertically adjustable securement into orifices 43 at the lateral ends of the opposite sides 14 and 16 of vertical wall 12. The base 36 for the elongated shelves 46 preferably has a length of approximately 3 feet. Other lengths, however, can be used, and several bases could be secured to each other to create a long display unit if desired.

Like the elongated shelves, curved shelves also have horizontal or outwardly- and downwardly-extending merchandise receiving surfaces. These curved shelves, like horizontal or flat, curved shelf 50 having horizontal merchandise receiving surfaces 51, are securable to the merchandise display unit 10 at the opposite ends 18 and 20 of the upright walls. As may be seen in the exploded view of FIG. 2, these curved shelves are secured to and are a portion of an end cap assembly 52. This end cap assembly includes an end cap base 54 and a generally tubular element 56. Tubular element 56 has a plurality of slots 58 for receiving four tabs 60 which are an integral portion of the curved shelves. These tabs 60 facilitate support for the curved shelves on the tubular element 56. The tabs 60 also permit the curved shelves to be moved vertically for securement to any of the slots 58 extending along substantially the entire height of tubular element 56.

Figure 6:
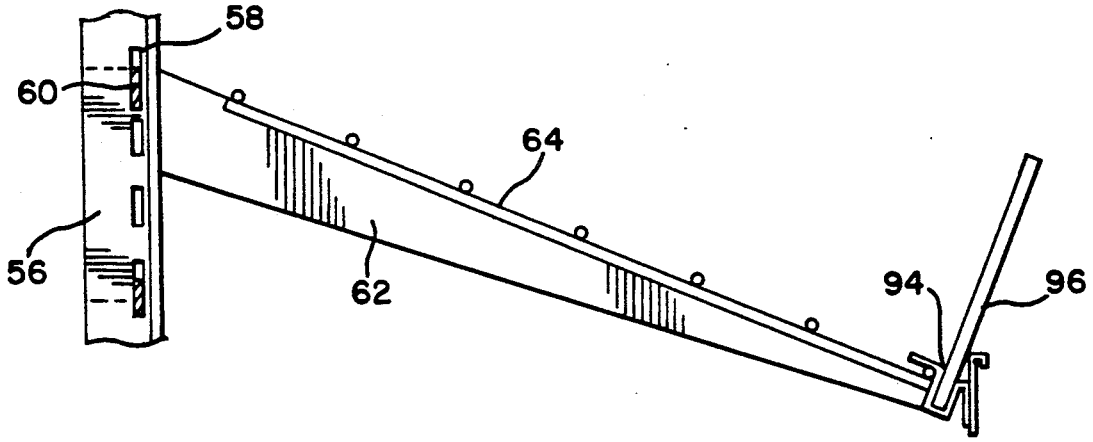
FIG. 6 is a side view of one example of a curved shelf for use with the invention having sloping merchandise receiving surfaces; and further showing a diagonal, upwardly-opening slot along a peripheral edge of the shelf for retaining a goods-retaining face.

Shown in FIG. 6 is a curved shelf 62 having a sloping surface, i.e., an outwardly- and downwardly-extending merchandise receiving surface 64. Such sloping-surfaced curved shelves 62 are secured to the tubular element 56 in the same manner as the flat, curved shelves 50.

For the purposes of this specification, the term "curved shelf" is intended to mean any configuration of shelf which may visually unite elongated shelves on opposite sides 14 and 16 of the vertical wall 12. This may be seen in FIG. 2, where a sloped, curved shelf 66 is at the same horizontal level as two elongated shelves 68 and 70. The elongated shelves 68 and 70 are secured to opposite sides 14 and 16, respectively, of vertical wall 12. Thus, "curved shelf" means a shelf which is essentially semi-circular, as viewed from above. As may be seen from FIG. 3, curved shelves, such as shelf 50, are semi-hexagonal in shape when viewed from above. It is, however, "curved" or "semi-circular" for the purposes of this invention in that it sweeps around from one side 14 of the vertical wall 12 to the other side 16 to join elongated shelves 68 and 70 on opposite sides of the wall. This creates the effect of one substantially oval shelf at a given horizontal level. It will be appreciated by those skilled in the art that "curved" shelves may include shelves that are truly semi-circular, or that are semi-pentagonal, semi-heptagonal and so on.

A 120° angle is formed by each two adjacent sides of the preferred semi-hexagonal curved shelf 50 of the present invention. This semi-hexagonal curved shelf 50 is preferred because of its pleasing appearance and space efficiency. Moreover, because of its overall height below the eye level of most persons, the modular merchandise display unit 10 of the present invention permits shoppers to view adjacent merchandise display shelves or units.

As indicated above, substantially vertical wall 12 includes a pair of stakes, including stake 28, for securing that wall 12 into axially-disposed sockets 32 and 34. In this embodiment, the length and width of the stakes and their respective sockets 32 and 34 are approximately 2 inches by 1 inch. When the wall 12 is in these axially-disposed sockets 32 and 34, as shown in the solid lines of FIG. 3, the unit 10 takes on a symmetrical appearance. Elongated shelves 68 and 70 on opposite sides of substantially vertical wall 12 have an identical 11 inch width.

In contrast, when its stakes, including stake 28, are inserted into the offset sockets 38 and 40, the offset position of the substantially vertical wall 12 gives the merchandise display unit 10 an asymmetrical appearance. To ensure that the smooth, flowing appearance of the merchandise display unit is retained, however, the elongated shelves (not shown) on opposite sides of the offset wall 12 are of different widths. Particularly, the 3 inch offset of the vertical wall 12 from the central axis C requires that elongated shelf extending from opposite side 16 has a width of 14 inches and elongated shelf extending from opposite side 14 has a width of 8 inches. In this manner, the outer peripheral edges of these 11 and 8 inch elongated shelves merge smoothly into the sweeping, outer peripheral edges of their adjacent curved shelves.

As stated above, both the elongated and curved shelves of the modular merchandise display unit 10 of the present invention can include flat and sloping merchandise receiving surfaces. Examples of an elongated shelf with a sloping surface is elongated shelf 46 (FIGS. 1 and 2). Examples of curved shelves with flat and sloping surfaces are 50 and 66, respectively.

Figure 5:
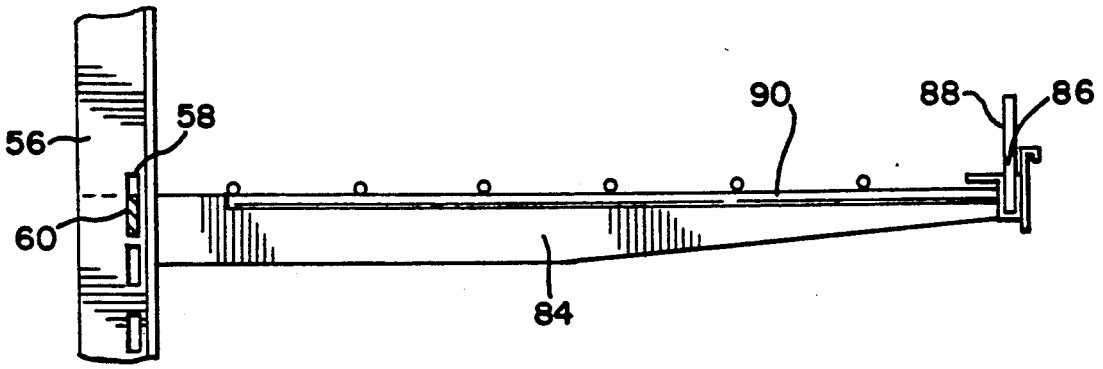
FIG. 5 is a perspective view of a flat-surfaced, curved shelf; and showing a vertically-disposed, upwardly-opening slot.

These elongated and curved shelves can include upwardly-opening slots along the peripheral edges of each for retaining a goods-retaining face. FIG. 5 shows an example of a flat-surfaced, curved shelf 84 having such an upwardly-opening slot 86. In this FIG. 5, the upwardly-opening slot 86 is vertically disposed. It will be understood, however, that the upwardly-opening slot could also be diagonally disposed.

This vertically-disposed, upwardly-opening slot 86 retains a goods-retaining face 88. This goods-retaining face 88 is typically a thin, clear piece of plastic that has a height of about 2 inches. Because a portion of the face is contained in the slot 86, only approximately 1 inch of the face 88 extends above the floor 90 of the shelf 84. This 1 inch portion of the face 88 aids in preventing goods from being inadvertently removed from the shelf 84, and also keeps those goods from falling to the floor, where they are subject to breakage, and create slip and fall hazards for shoppers.

FIG. 6 shows an example of a curved shelf 62 having a sloping floor 64. The peripheral edge of this curved shelf 62 has a diagonal, upwardly-opening slot 94 for insertion of a clear, goods-retaining face 96.

Figure 7:
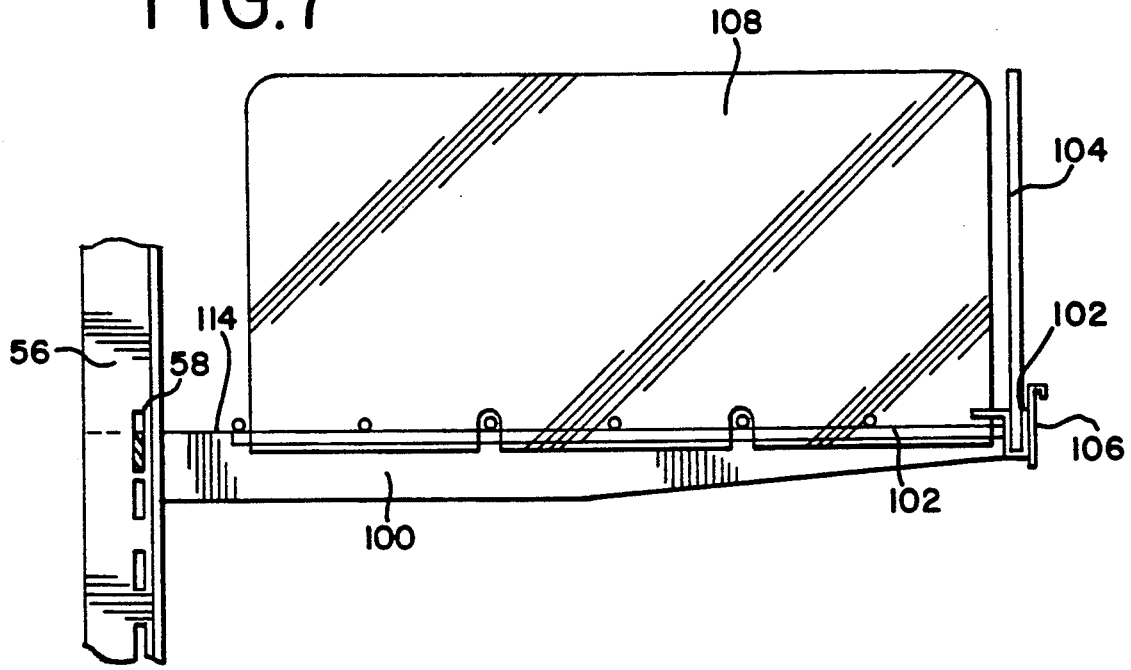
FIG. 7 is a side view of a flat, curved shelf having vertical, upwardly-opening slots, with faces having a height of approximately 5 inches; and further indicating how these faces and a clear plastic divider enables the creation of bins from this shelf.

Finally, FIG. 7 shows an example of a flat, curved shelf 100 having vertical, upwardly-opening slots 102 for insertion of a plurality of clear, goods-retaining faces 104. Unlike the faces 104 described above, these faces 104 have a height of 5 inches or more. When these faces 104 are placed in their respective slots 102 all around the periphery of curved shelf 100, their side-to-side relationship effectively creates a wall which surrounds the periphery 106 of shelf 100. In this manner, a bin is effectively created, suitable for containing many more small items than would fit on a flat, curved shelf with lower 1 inch faces.

This FIG. 7 also suggests how various sub-bins can be created from this single bin. A clear, flat, plastic divider 108 having four to six tabs 110 is inserted into an opening 112 (FIG. 9) on the merchandise receiving surface 114 of shelf 100. In this embodiment, opening 112 is created or defined by a pair of substantially parallel wires 116 and 118.

Figure 8:
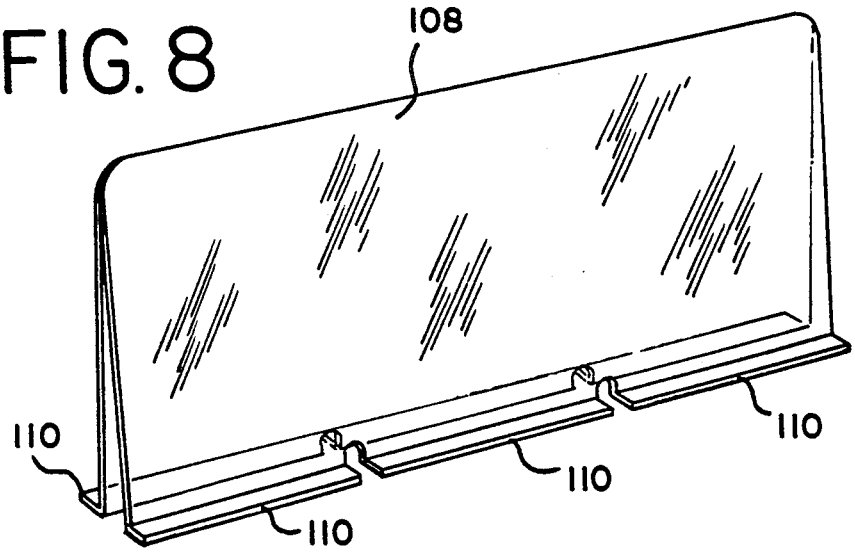
FIG. 8 is a perspective view of the divider shown in FIG. 7.

The divider 108 (FIG. 8) and its integral tabs 110 are preferably molded in one piece from a resilient material. The tabs 110 extend at an angle of approximately 45° from the plane of the remainder of the divider 108. The resiliency of the divider permits one to bend those tabs 110 into substantial alignment with the divider. The tabs 110 are then inserted through the opening 112 created by the two parallel wires 116 and 118. When the tabs 110 are thereafter released, their resiliency causes them to reassume their original configuration, i.e., a configuration offset 45° from the divider 108. The tension of the tabs 110 on the wires 116 and 118 secures the divider 108 in place. To remove the divider 108 from the opening 112, one can either (1) compress the tabs, and pull lightly and upwardly on the divider 108; or (2) pull upwardly on the divider 108 with substantial force, causing the tabs 110 to flex and clear the opening 112, thereby permitting removal of the divider 108 from the opening 112.

The second embodiment of the invention is shown in FIG. 9. In this embodiment, a pair of end cap modules 120 and 122 are secured in a back-to-back relationship. Each module 120 and 122 is identical to and interchangeable with end cap assembly 52. Thus, all aspects of these modules 120 and 122 are like those of corresponding end cap assembly 52. Particularly, each module 120 and 122 includes a plurality of curved shelves 124 and 126. Each shelf has at least one tab (not shown) for securing the shelves to respective supporting structures 128 and 130. Tubes 132 and 134 are provided, and each of these tubes has a plurality of vertically spaced-apart slots (not shown) for receiving the tabs of the vertically adjustable shelves and supporting the shelves. A base provides support for the tubes 132 and 134. The tubes in this embodiment are 2 inches by 2 inches square, and are supported by sockets in their respective bases. It will be understood, however, that these tubes may have non-square configurations as well.

As may be seen by FIG. 9, when two of these modules 120 and 122 are placed in this back-to-back relationship, they form a generally round modular merchandise display unit. In fact, the semi-hexagon shelves of this embodiment together create a hexagonal unit. Although the generally round modular display unit of this FIG. 9 is shown with semi-hexagonal shelves, it will be understood that the shelves may also be formed of other shapes as well, such as semi-circular, semi-pentagonal, semi-heptagonal and so on.

Nut and bolt securement means (not shown) are used to attach the base 36 for elongated shelves 42 to the end cap base 54. Similar nut and bolt securement means secure end cap modules 120 and 122 to each other.

While specific embodiments have been illustrated and described, numerous modifications can be made without markedly departing from the spirit of the invention. The scope of protection is, thus, only intended to be limited by the scope of the accompanying claims.

What I claim is:

1. A modular merchandise display unit, said unit comprising:

a. an upright, substantially vertical wall having opposite sides, a pair of opposite ends, and at least one stake at a lower end and being positionable along a central axis of said merchandise display unit;

b. a base for supporting said upright wall, said base including a pair of axially-disposed sockets and a pair of offset sockets;

c. a plurality of elongated shelves with merchandise receiving surfaces, said shelves being removably connected to and extending outwardly from said opposite sides of said upright wall;

d. curved shelves securable to said merchandising display unit at said opposite ends of said upright walls, and having surfaces which merge smoothly with the surfaces of a pair of elongated shelves, each of said pair of elongated shelves being on said opposite sides of said upright walls;

wherein said at least one stake engages said axially-disposed sockets for positioning said upright wall along said central axis and said at least one stake engages said offset sockets for positioning said upright wall in a position offset from said central axis.

2. The modular merchandise display unit of claim 1, wherein said curved shelves are semi-hexagonal.

3. The modular merchandise display unit of claim 1, wherein said merchandise receiving surfaces of said elongated and curved shelves are substantially horizontal.

4. The modular merchandise display unit of claim 1, wherein said merchandise receiving surfaces of said elongated and curved shelves extend downwardly and outwardly from said upright wall.

5. The modular merchandise display unit of claim 3, further comprising an upwardly-opening slot along a peripheral edge of each of said curved shelves for retaining a goods-retaining face.

6. The modular merchandise display unit of claim 4, further comprising an upwardly-opening slot along a peripheral edge of each of said curved shelves for retaining a goods-retaining face.

7. The modular merchandise display unit of claim 4, further comprising a diagonal, upwardly-opening slot along a peripheral edge of said curved shelves for retaining a goods-retaining face.

8. The modular merchandise display unit of claim 1, wherein said merchandise-receiving surface includes an opening for receiving a divider.

9. The modular merchandise display unit of claim 8, wherein said opening is defined by a pair of substantially parallel wires.

10. A modular merchandise display unit, said unit comprising:

a. an upright, substantially vertical wall having opposite sides and a pair of opposite ends, and being positionable along a central axis of said merchandise display unit, said wall including at least one stake at its lower end;

b. a base for securing said upright wall;

c. a plurality of elongated shelves with merchandise receiving surfaces, said shelves being removably connected to and extending outwardly from said opposite sides of said upright wall;

d. curved shelves securable to said merchandise display unit at at least one of said opposite ends of said upright walls; and e. first sockets formed in the base of said merchandise display unit engaging said at least one positioning stake for said upright wall in said position along said central axis and second sockets engaging said at least one stake for positioning said upright wall in a position offset from said central axis.

11. The modular merchandise display unit of claim 10, wherein said curved shelves are semi-hexagonal.

12. The modular merchandise display unit of claim 10, wherein said merchandise receiving surfaces of said shelves are substantially horizontal.

13. The modular merchandise display unit of claim 10, wherein said merchandise receiving surfaces of said shelves extend downwardly and outwardly from said upright wall.

14. The modular merchandise display unit of claim 12, further comprising an upwardly-opening slot along a peripheral edge of each of said shelves for retaining a goods-retaining face.

15. The modular merchandise display unit of claim 13, further comprising an upwardly-opening slot along a peripheral edge of each of said shelves for retaining a goods-retaining face.

16. The modular merchandise display unit of claim 13, further comprising a diagonal, upwardly-opening slot along a peripheral edge of said shelves for retaining a goods-retaining face.

17. The modular merchandise display unit of claim 10, wherein said merchandise-receiving surface includes an opening for receiving a divider.

18. The modular merchandise display unit of claim 17, wherein said opening is defined by a pair of substantially parallel wires.

* * * * *

UNITED STATES PATENT AND TRADEMARK OFFICE

CERTIFICATE OF CORRECTION

PATENT NO. : 5,322,024

DATED : June 21, 1994

INVENTOR(S) : Frederick M. Avery et al.

It is certified that error appears in the above-indentified patent and that said Letters Patent is hereby corrected as shown below:

Column 8, Claim 10, line 10, delete "positioning".

Column 8, Claim 10, line 11, after "for" insert --positioning--.

Signed and Sealed this

Twenty-seventh Day of December, 1994

*Attest:*

Bruce Lehman

BRUCE LEHMAN

*Attesting Officer*

*Commissioner of Patents and Trademarks*